US011814272B2

(12) United States Patent
He et al.

(10) Patent No.: US 11,814,272 B2
(45) Date of Patent: Nov. 14, 2023

(54) JACK WITH DOUBLE HIGH-PRESSURE STRUCTURE

(71) Applicant: FUYANG TONGLI INDUSTRIAL CO., LTD., Hangzhou (CN)

(72) Inventors: Yufeng He, Hangzhou (CN); Weixiang He, Hangzhou (CN); Gang Sun, Hangzhou (CN)

(73) Assignee: FUYANG TONGLI INDUSTRIAL CO., LTD., Hangzhou (CN)

( * ) Notice: Subject to any disclaimer, the term of this patent is extended or adjusted under 35 U.S.C. 154(b) by 130 days.

(21) Appl. No.: 17/467,476

(22) Filed: Sep. 7, 2021

(65) Prior Publication Data

US 2022/0098014 A1 Mar. 31, 2022

(30) Foreign Application Priority Data

Sep. 27, 2020 (CN) ..... 202022148003.3

(51) Int. Cl.
*B66F 3/26* (2006.01)

(52) U.S. Cl.
CPC ..... *B66F 3/26* (2013.01)

(58) Field of Classification Search
CPC .... B66F 3/24; B66F 3/26; B66F 3/247; B66F 3/28; B66F 3/42; B66F 5/04; B66F 7/04; B66F 7/08; F15B 13/02–029
See application file for complete search history.

(56) References Cited

U.S. PATENT DOCUMENTS 5,201,494 A * 4/1993 Lundman ..... B66F 5/04 254/8 B
2004/0183057 A1* 9/2004 Bruzek ..... B66F 3/42 254/93 H

FOREIGN PATENT DOCUMENTS

EP 0418580 A1 * 3/1991

* cited by examiner

*Primary Examiner* — Tyrone V Hall, Jr.
(74) *Attorney, Agent, or Firm* — Bayramoglu Law Offices LLC

(57) ABSTRACT

A jack with a double high-pressure structure is provided, including a base, a pump body installed on the base, an oil cylinder, an oil drain valve, and a safety valve. The base is provided with a low-pressure check valve and a high-pressure check valve A. It is characterized in that a high-pressure check valve B is also installed on the base. The present invention can improve the safety performance during use and prolong the service life.

5 Claims, 3 Drawing Sheets

JACK WITH DOUBLE HIGH-PRESSURE STRUCTURE

CROSS REFERENCE TO THE RELATED APPLICATIONS

This application is based upon and claims priority to Chinese Patent Application No. 202022148003.3, filed on Sep. 27, 2020, the entire contents of which are incorporated herein by reference.

TECHNICAL FIELD

The present invention relates to the technical field of jacks, in particular to a jack with a double high-pressure structure.

BACKGROUND

With the development of society, a jack is used in various industries to support various items or is used for lifting, etc., but in the prior art, there is only one high-pressure check valve in a jack. When the high-pressure check valve is damaged, a pressure difference is formed in the hydraulic system of the jack, thus the jack does not work. Moreover, when the high-pressure check valve is damaged and the piston rod is pressed, the pressure of hydraulic oil in the oil cylinder acts directly on the pump core, causing the operating arm to lift or eject, resulting in injury to the staff. For this reason, a jack with a double high-pressure structure is proposed.

SUMMARY

The purpose of the present invention is to propose a jack with a double high-pressure structure in order to address the above issues.

In order to achieve the above purpose, the present invention provides the following technical solution. The jack with the double high-pressure structure includes a base, a pump body installed on the base, an oil cylinder, an oil drain valve, and a safety valve; the base is mounted with a low-pressure check valve and a high-pressure check valve A; and the characteristic is that a high-pressure check valve B is also installed on the base.

Preferably, a pump core is mounted on the pump body installed on the base; a spring and a fixed plate are mounted on the pump core; and a shell is mounted on the fixed plate.

Preferably, an oil pass pipe is arranged in the base; a connecting pipe is arranged between the oil pass pipe and the oil cylinder; an oil inlet pipe is arranged between the oil pass pipe and the pump body; the low-pressure check valve and the high-pressure check valve A are installed in the oil pass pipe; and the high-pressure check valve B is installed in the connecting pipe.

Preferably, an outer cover is provided outside the oil cylinder; the outer cover is fixedly installed on the base; an oil inlet is arranged on the outer cover; a piston rod is installed in the oil cylinder; and hydraulic oil is arranged between the oil cylinder and the outer cover.

Preferably, a piston and a guide sleeve are arranged on the piston rod; a seal ring is arranged between the piston and the oil cylinder; and a first seal ring is installed between the guide sleeve and the piston rod as well as between the guide sleeve and the oil cylinder.

The present invention has the advantages that the jack has improved safety performance during use and prolonged service life.

Figure 1:
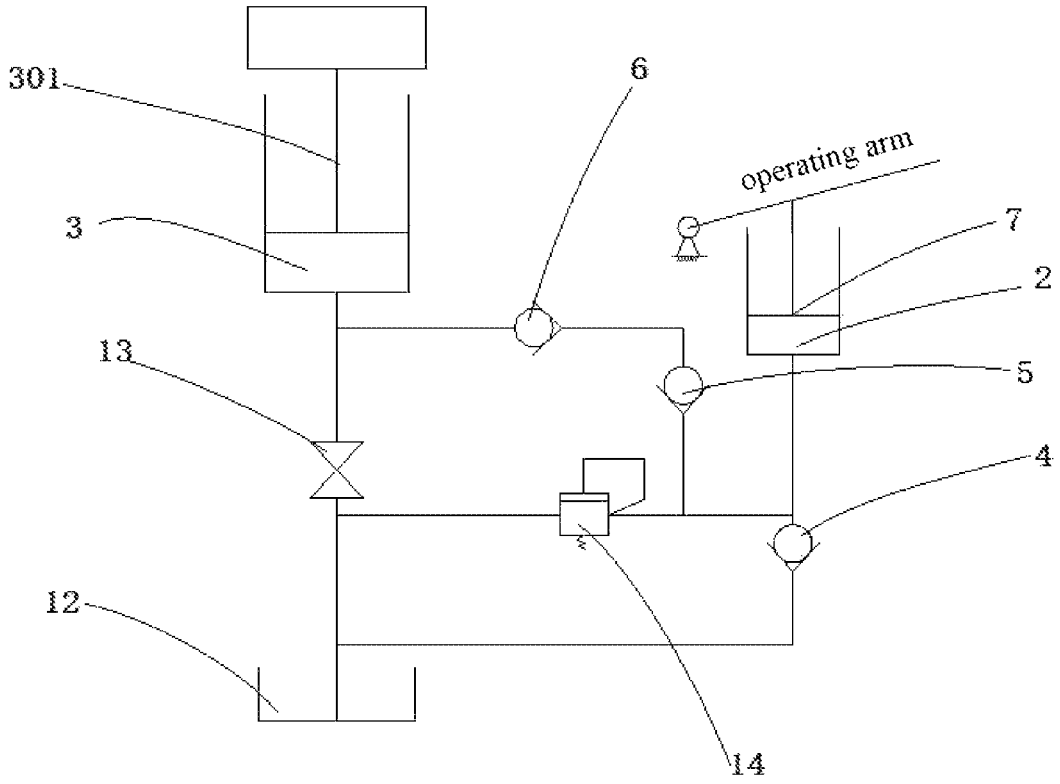
FIG. 1 is a schematic diagram of the present invention.

In the drawings: 1 base; 101 oil pass pipe; 102 connecting pipe; 103 oil inlet pipe; 2 pump body; 3 oil cylinder; 301 piston rod; 302 piston; 303 guide sleeve; 304 seal ring; 305 first seal ring; 4 low-pressure check valve; 5 high-pressure check valve A; 6 high-pressure check valve B; 7 pump core; 8 spring; 9 fixed plate; 10 shell; 11 outer cover; 1101 oil inlet; 12 hydraulic oil; 13 oil drain valve; 14 safety valve.

DETAILED DESCRIPTION OF THE EMBODIMENTS

The jack with the double high-pressure structure described in the present invention is further illustrated below in conjunction with the accompanying drawings.

Referring to FIG. 1, the jack with the double high-pressure structure in this embodiment includes the base 1, the pump body 2 installed on the base 1, the oil cylinder 3, the oil drain valve 13, and the safety valve 14. The base 1 is mounted with the low-pressure check valve 4 and the high-pressure check valve A 5. It is characterized in that the high-pressure check valve B 6 is also installed on the base 1; and the pump core 7 is installed on the pump body 2 that is installed on the base 1. The pump core 7 is mounted with the spring 8 and the fixed plate 9; and the fixed plate 9 is mounted with the shell 10. The high-pressure check valve B 6 is installed on the base 1, which can prevent the operating arm lifting caused by the situation that the pressure of hydraulic oil acts directly on the pump core 7 even when one of the high-pressure check valve B 6 and the high-pressure check valve A 5 is damaged, thereby playing the role of double insurance and improving the safety of use.

Figure 2:
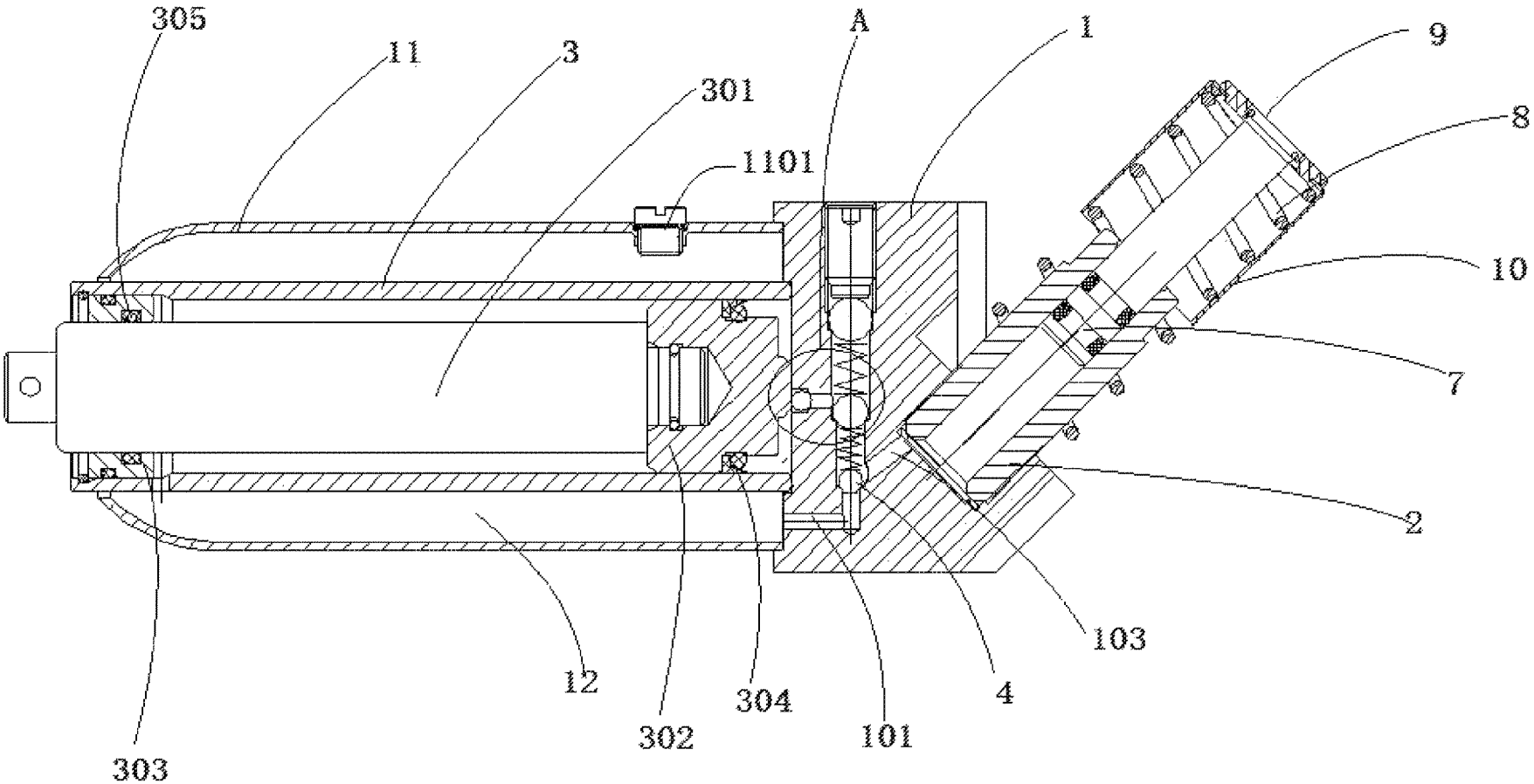
FIG. 2 is a structural diagram of the present invention.
Figure 3:
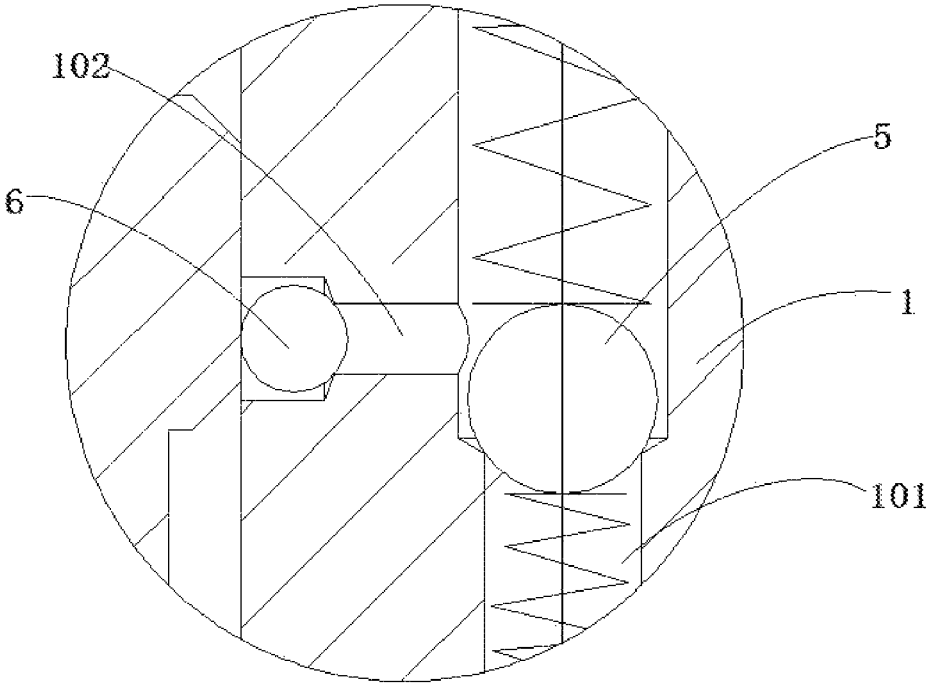
FIG. 3 is a partially enlarged view of the present invention.

Referring to FIGS. 2 and 3, the oil pass pipe 101 is arranged in the base 1; the connecting pipe 102 is arranged between the oil pass pipe 101 and the oil cylinder 3; the oil inlet pipe 103 is arranged between the oil pass pipe 101 and the pump body 2; the low-pressure check valve 4 and the high-pressure check valve A 5 are installed in the oil pass pipe 101; and the high-pressure check valve B 6 is installed in the connecting pipe 102.

Referring to FIG. 2, the outer cover 11 is arranged outside the oil cylinder 3; the outer cover 11 is welded and installed on the base 1; the oil inlet 1101 is arranged on the outer cover 11; the piston rod 301 is installed in the oil cylinder 3; the hydraulic oil 12 is arranged between the oil cylinder 3 and the outer cover 11; and the piston 302 and the guide sleeve 303 are installed on the piston rod 301. The seal ring 304 is installed between the piston 302 and the oil cylinder 3. The first seal ring 305 is installed between the guide sleeve 303 and the piston rod 301 as well as between the guide sleeve 303 and the oil cylinder 3. The oil inlet 1101 is arranged on the outer cover 11, which is conducive to replacing the hydraulic oil between the oil cylinder 3 and the outer cover 11. The seal ring 304 is arranged between the piston 302 and the oil cylinder 3, and the first seal ring 305 is installed between the guide sleeve 303 and the piston rod 301 as well as between the guide sleeve 303 and the oil cylinder 3, thereby increasing the air impermeability of the oil cylinder 3.

In the working process of the present invention, the hydraulic oil 12 enters the oil pass pipe 101, and pushes the low-pressure check valve 4 aside and gets in the pump body 2 through the oil inlet pipe 103. Subsequently, workers utilize a lever to squeeze down the pump core 7, and enable the hydraulic oil in the pump body 2 to push the high-pressure check valve A 5 and enter the connecting pipe 102. The hydraulic oil entering the connecting pipe 102 pushes the high-pressure check valve B 6 and gets in the oil cylinder 3. The hydraulic oil entering the oil cylinder 3 pushes the piston rod 301 to move, and heavy items are lifted as the piston rod 301 moves. When the heavy items need to be released, the oil drain valve 13 is opened to drain the hydraulic oil from the oil cylinder 3 back into the outer cover 11, and the piston rod 301 slowly moves downward to the original position as the hydraulic oil decreases.

The above embodiment is an explanation of the present invention, rather a limitation to the present invention. Any proposal based on simple transformation of the present invention belongs to the protection scope of the present invention.

The invention claimed is:

1. A jack with a double high-pressure structure, said jack comprising:

a base member;

a pump body provided on the base member;

an oil cylinder secured to said base member;

an oil pass pipe arranged within said base member, wherein hydraulic oil is pumped into the pump body from the oil pass pipe to implement lifting of the jack;

a connecting pipe arranged between the oil pass pipe and the oil cylinder, said connecting pipe providing a direct fluid communication between said oil pass pipe and said oil cylinder;

an oil drain valve;

a safety valve, said oil drain valve and said safety valve being in fluid communication with said oil cylinder;

a low-pressure check valve provided within the base member;

a first high-pressure check valve provided within the base member; and a second high-pressure check valve provided within the base member;

wherein said second high-pressure check valve laterally and separately spaced from said first high-pressure check valve; said second high-pressure check valve extending in a transverse direction with respect to said first high-pressure check valve; and wherein said second high-pressure check valve is arranged within the connecting pipe and said first high-pressure check valve is arranged within said oil pass pipe.

2. The jack with the double high-pressure structure according to claim 1, wherein a pump core is mounted within the pump body that is provided on the base member; a spring and a fixed plate are provided about the pump core; and a shell being secured underneath the fixed plate and about said spring.

3. The jack with the double high-pressure structure according to claim 1, wherein an oil inlet pipe is arranged between the oil pass pipe and the pump body; and the low-pressure check valve being arranged within the oil pass pipe.

4. The jack with the double high-pressure structure according to claim 3, wherein an outer cover is provided outside the oil cylinder; the outer cover is fixedly mounted on the base member; an oil inlet is arranged on the outer cover; a piston rod is provided within the oil cylinder; and said hydraulic oil is contained between the oil cylinder and the outer cover.

5. The jack with the double high-pressure structure according to claim 4, wherein a piston and a guide sleeve are arranged on the piston rod; a seal ring is provided between the piston and the oil cylinder; and a first seal ring is provided between the guide sleeve and the piston rod as well as between the guide sleeve and the oil cylinder.

* * * * *